US011408292B2

(12) United States Patent
Rousseaux et al.

(10) Patent No.: US 11,408,292 B2
(45) Date of Patent: Aug. 9, 2022

(54) TURBOMACHINE STATOR

(71) Applicant: SAFRAN AIRCRAFT ENGINES, Paris (FR)

(72) Inventors: Hugo Louis Rousseaux, Moissy-Cramayel (FR); Pamela Jessica Benevent, Moissy-Cramayel (FR); Léna Jeffroy, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 17/278,903

(22) PCT Filed: Sep. 6, 2019

(86) PCT No.: PCT/FR2019/052057
§ 371 (c)(1),
(2) Date: Mar. 23, 2021

(87) PCT Pub. No.: WO2020/065161
PCT Pub. Date: Apr. 2, 2020

(65) Prior Publication Data

US 2022/0042419 A1 Feb. 10, 2022

(30) Foreign Application Priority Data

Sep. 26, 2018 (FR) ..... 1858804

(51) Int. Cl.
*F01D 9/02* (2006.01)
*F01D 11/00* (2006.01)

(52) U.S. Cl.
CPC ..... *F01D 9/02* (2013.01); *F01D 11/005* (2013.01); *F05D 2240/128* (2013.01); *F05D 2240/55* (2013.01)

(58) Field of Classification Search
CPC ..... F01D 9/02; F01D 9/023; F01D 11/005; F05D 2240/55; F05D 2240/128
See application file for complete search history.

(56) References Cited

U.S. PATENT DOCUMENTS 4,314,793 A * 2/1982 DeTolla ..... F01D 11/005 415/137
10,077,669 B2 * 9/2018 Bifulco ..... F01D 11/005
(Continued)

FOREIGN PATENT DOCUMENTS

EP 1296023 A1 3/2003
EP 3091188 A1 11/2016
FR 2955145 B1 2/2012

OTHER PUBLICATIONS

International Search Report in corresponding Application No. PCT/FR2019/052057, dated Dec. 18, 2019, (2 pages).
(Continued)

*Primary Examiner* — Courtney D Heinle
*Assistant Examiner* — Danielle M. Christensen
(74) *Attorney, Agent, or Firm* — Bookoff McAndrews, PLLC.

(57) ABSTRACT

Turbine nozzle for a turbomachine extending about an axis, the nozzle including a plurality of sectors each having at least one vane which extends radially between an internal platform and an external platform, the nozzle including at least two sealing strips each including a main portion configured to ensure the sealing between the nozzle and an element of the turbomachine which is adjacent to the nozzle, and a first portion folded relative to the main portion, the first folded portion being in contact with an outer face of at least one platform, each strip being held to the at least one platform by a clamping device configured to clamp the first folded portion between the outer face of the platform and the clamping device.

10 Claims, 3 Drawing Sheets

(56) References Cited

U.S. PATENT DOCUMENTS

| | | | | |
|---|---|---|---|---|
| 2005/0095123 | A1* | 5/2005 | Taillant | F01D 11/005 415/174.2 |
| 2006/0127219 | A1* | 6/2006 | Zborovsky | F01D 11/005 415/229 |
| 2012/0200046 | A1* | 8/2012 | Green | F01D 11/005 277/647 |
| 2016/0153299 | A1 | 6/2016 | Tuertscher et al. | |

OTHER PUBLICATIONS

French Search Report in corresponding Application No. FR 1858804, dated May 28, 2019, (2 pages).

* cited by examiner

- - PRIOR ART - -

- - PRIOR ART - -

TURBOMACHINE STATOR

CROSS-REFERENCE TO RELATED APPLICATION(S)

This patent application is a National Phase of and claims the benefit of priority to Application No. PCT/FR2019/052057, filed on Sep. 6, 2019, which claims the benefit of French Application No. 1858804, filed on Sep. 26, 2018, the entireties of which are incorporated herein by reference.

FIELD OF THE INVENTION

The present invention concerns the field of aeronautical turbomachines, and more specifically a nozzle for a turbomachine turbine, and a turbomachine including such a nozzle.

STATE OF THE PRIOR ART

High-pressure or low-pressure nozzles of turbomachines, as described in document FR 2 955 145, include in particular fixed vanes held at each of their radial ends by an internal platform and an external platform, these defining a flowpath of circulation of gases ejected through the combustion chamber. These vanes allow directing the flow of the gases exiting the combustion chamber on the rotor vanes of the turbine. These vanes are hollow, and include at least one cavity, one end of which opens out outside the flowpath. These vanes being exposed to the hot combustion gases, it is necessary to cool them in order to reduce the thermal stresses. One solution consists in using air coming from another element of the turbomachine, for example the compressor. More specifically, relatively cool air is drawn upstream of the combustion chamber at the outlet of a stage of the compressor. This air is injected into the cavity/cavities of the vanes through either of its/their ends, to cool them from inside. The air then escapes into the flowpath through holes made in the vanes and communicating with the cavity/cavities of the vane and with the flowpath, the cooling air creating a protective film of cooler air flowing along the vane.

In addition, the vanes/internal and external platforms assembly is fixed to the casing of the turbine. Sealing strips and seal covers are fixed at the platforms by fixing means (slugs/rivets), in order to ensure the sealing between the nozzle and the outer casing.

However, it may happen that during flight, mechanical stresses such as shear stresses between slugs/rivets and sealing strips or seal covers cause the loss of these sealing strips and seal covers. These can then be released and sucked by the nozzle. Particularly, the cooling air entering the cavities of the vane can drive these sealing strips and seal covers towards these cavities. The sealing strips and the seal covers are then likely to partially or totally block these cavities. The cooling of the vanes is then no longer or insufficiently ensured. The temperature of the vanes may then increase, which could lead to the deterioration of the properties of the vanes.

There is therefore a need for a device that allows solving the technical problem above.

PRESENTATION OF THE INVENTION

The present disclosure concerns a turbine nozzle for a turbomachine extending radially about an axis, the nozzle including a plurality of sectors each comprising at least one vane which extends radially between an internal platform and an external platform, the nozzle including at least two sealing strips each including a main portion configured to ensure the sealing between the nozzle and an element of the turbomachine which is adjacent to the nozzle, and a first portion folded relative to the main portion, the first folded portion being in contact with an outer face of at least one platform, each strip being held to the at least one platform by a clamping means configured to clamp the first folded portion between the outer face of the platform and the clamping means.

In the present disclosure, the term "radial" and its derivatives refer to a radial direction of the turbine, i.e. a direction perpendicular to the axis of the turbine. In addition, the terms "upstream" and "downstream" are considered along the axis of the turbine, and along the direction of flow of the gases in the turbine, between the two platforms, i.e. in the gas circulation flowpath. Furthermore, the vanes are arranged between two platforms: a radially external platform and a radially internal platform, the internal and external platforms being annular or in the form of a ring sector and coaxial. In addition, the "outer face" of the platforms refers to the face of the platforms opposite the gas flowpath, the latter being delimited by the inner face of the platforms. In other words, the gas flowpath is delimited by the inner face of the external platform and the inner face of the internal platform.

The sealing strips may have the shape of a metal plate, for example made of a nickel-based and/or cobalt-based alloy and having a thickness of less than 1 mm.

The plate forming a sealing strip is folded, so as to form a first folded portion, and a main portion having a larger area than the folded portion.

The main portion of the strips is the portion of the strip having the largest surface, and extends on the one hand in a direction substantially parallel to the radial direction, or slightly inclined relative to the radial direction, and on the other hand in a circumferential direction, following the shape of the nozzle, such that the main portion has the shape of an arc of a circle.

The main portion of the strips is in contact with an element of at least one sector of the turbomachine, for example a shoulder of the sector disposed at an upstream or downstream end of the platform, and with an element of the turbomachine which is adjacent to the nozzle. This element of the turbomachine may be for example a part of an adjacent casing, or a flange of the combustion chamber.

The folded portion extends in the axial direction, i.e. from upstream to downstream, and is in contact with the outer face of the platform. The folded portion is held and clamped against the outer face of the platform through the clamping means. The latter is configured to hold and clamp the folded portion of each strip over the entire circumference of the nozzle, by exerting a pressure on the strips in the radial direction, so that the folded portions are sandwiched between the clamping means and the outer faces of the platforms. More specifically, the clamping means exerts a force on the strips directed radially towards the axis of the turbine when the strips are disposed on the external platform, and directed radially towards the direction opposite the axis of the turbine when the strips are disposed on the internal platform.

Consequently, according to the present disclosure, the fixing of the sealing strips to the nozzle is ensured by the first folded parts and the fixing means, and the sealing between the nozzle and the elements of the turbomachine which are adjacent to the nozzle is ensured by the main portion. The use of slugs and/or rivets that usually allows fixing the strips on the nozzle, for example on the shoulder of the sector disposed at an upstream and/or downstream end of the platform, is therefore no longer necessary. The risk of loss of the strips due to the shearing of the rivets is therefore reduced. Consequently, the risk of deterioration of the vanes, due to the blockage of the cooling cavities by the strips, is also reduced.

In some embodiments, the nozzle includes two strips each forming a half-ring, the clamping means being disposed around the nozzle so as to clamp the two strips against the outer faces of the platforms of the nozzle.

According to this configuration, each strip has the shape of a 180° arc of a circle. When several sectors are assembled so as to form the nozzle crown, each of the two 180° strips is fixed on the outer face of the adjacent platforms of the nozzle crown, and are held and clamped against these outer faces by the clamping means, the latter surrounding the nozzle over its entire circumference and thus holding the two strips simultaneously. The circumferential ends of the two strips are joined to each other so as to form a sealing ring which extends around the nozzle. The use of two strips allows limiting the number of parts required, limiting the inter-sector leaks and simplifying the mounting process.

In some embodiments, the main portion and the first folded portion of each strip form therebetween an angle comprised between 90° and 150°.

It is understood that this angle between the main portion and the first folded portion of each strip is the natural angle formed by these two portions of the strip, i.e. when no force tending to deform the strip, and therefore to modify this angle, is exerted on the strip. According to this configuration, the plate forming the strip is not folded so as to form a right angle between the main portion and the folded portion, but so as to form an obtuse angle therebetween. In other words, when the strip is fixed to a nozzle, the plane in which the main portion of the strip extends is not parallel relative to the radial direction, but slightly inclined relative thereto. This configuration allows improving the sealing between the nozzle and the element of the turbomachine which is adjacent to the nozzle. Indeed, through the inclination of the main portion, the element of the turbomachine which is adjacent to the nozzle comes into contact with the radial end of the main portion. This contact tends to deform the strip so as to reduce the angle between the main portion and the folded portion. The main portion, tending to return to its initial position by elasticity, thus acts as a spring by exerting a pressure on the element of the turbomachine which is adjacent to the nozzle. In other words, the contact pressure between the main portion of the strip and the element of the turbomachine which is adjacent to the nozzle is increased, thereby improving the sealing between this element and the nozzle.

In some embodiments, the strips each include a second folded portion extending from the first folded portion, substantially perpendicularly thereto, and coming into contact with a radial wall which protrudes radially from the at least one platform.

According to this configuration, the strips are folded so as to have three portions: the main portion, the first folded portion in contact with the outer face of the platform and the second folded portion, the first folded portion being interposed between the main portion and the second folded portion, such that, in a cross-section, the strip is substantially U-shaped.

The presence of the second folded portion allows limiting the movements of the clamping means along the axial direction. More specifically, the strip thus folded takes the form of a gutter in which the clamping means is housed, thus limiting its axial movements and limiting the risks that a sufficient clamping of the strip against the platform is no longer ensured. By sufficient clamping, it is understood a clamping that allows preventing the strip from detaching during a normal operation of the turbomachine.

In some embodiments, two strips circumferentially adjacent around the nozzle are disposed such that a circumferential end of the main portion of a strip is superimposed on a circumferential end of the main portion of a circumferentially adjacent strip.

In some embodiments, the circumferential end of the main portion of a strip and the circumferential end of the main portion of the adjacent strip are superimposed over a distance comprised between 1 and 10 mm.

In other words, the dimensions of each strip are provided such that the circumferential ends thereof overlap with each other, over their entire height. It is understood by "height" their length in the radial direction. For example, when the nozzle includes two 180° strips each forming a half-ring, the circumference of one of the two strips is substantially greater than the other of the two strips, so as to overlap the ends of the latter.

This configuration allows avoiding the presence of a clearance between the circumferential ends of each strip, and therefore improving the sealing between the nozzle and an element of the turbomachine which is adjacent to the nozzle.

In some embodiments, the clamping means includes at least one clamping surface, the clamping surface being in contact with the first folded portion.

The presence of at least one planar clamping surface allows obtaining a planar contact between the clamping means and the first folded portion, increasing the contact surface, and therefore the reliability of clamping of the strip on the platform.

In some embodiments, the clamping means is a bead.

It is meant by "bead" a ring, preferably metal ring, having two free ends facing each other but disjoint from each other. This device has the advantage of being simple and inexpensive.

In some embodiments, the nozzle includes at least one slat fixed to the radial wall and configured to exert a pressure on a strip.

The slat is fixed to the radial wall and is oriented so as to bear on a strip of the nozzle, thus exerting a pressure thereon. This allows exerting a pressure against the main portions of the strips, and thus increasing the contact pressure between the main portions and the element of the turbomachine which is axially adjacent to the nozzle, thus further improving the sealing.

The present disclosure also concerns a turbomachine including a nozzle according to any one of the preceding embodiments.

BRIEF DESCRIPTION OF THE DRAWINGS

The invention and its advantages will be better understood upon reading the detailed description given below of various embodiments of the invention given by way of non-limiting examples. This description refers to the pages of appended figures, on which.

DETAILED DESCRIPTION OF EXEMPLARY EMBODIMENTS

Figure 1:
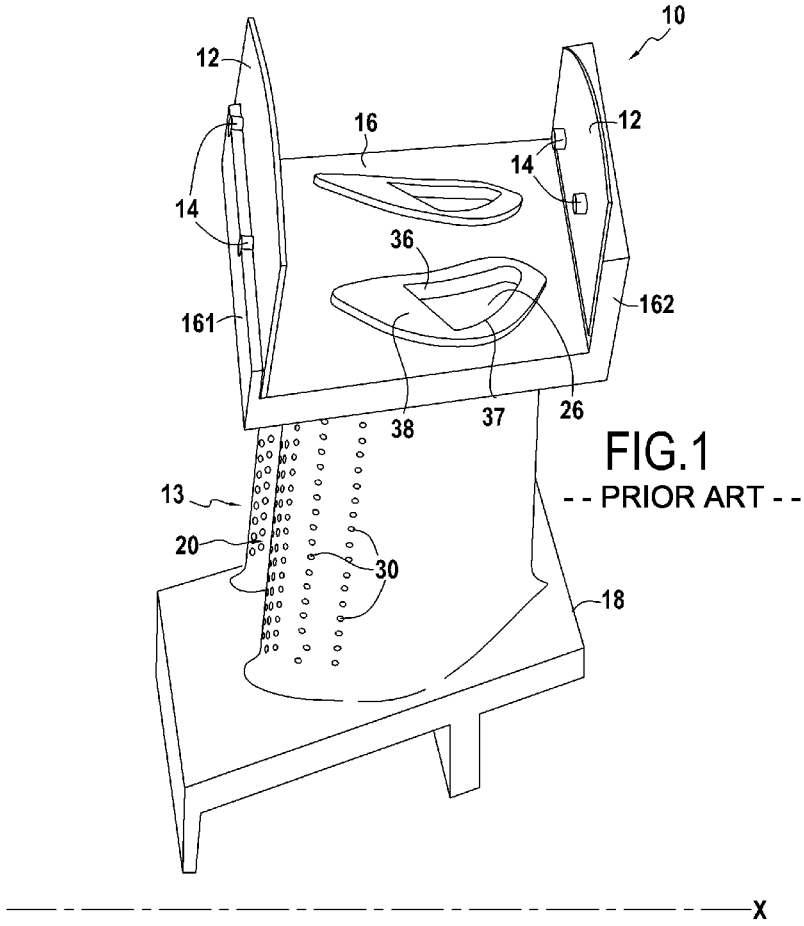
FIG. 1 represents a partial perspective view of a turbine nozzle for a turbomachine according to the prior art.

FIG. 1 represents a sector 10 of a nozzle for a high-pressure turbine of a turbomachine according to the prior art, the nozzle including a crown of hollow fixed vanes 13, arranged between two coaxial annular platforms: an external platform 16 and an internal platform 18. The platforms are formed by ring sectors which extend about the axis X and which delimit a gas circulation flowpath 20 in which the vanes 13 evenly distributed circumferentially are located and which extend radially between the platforms 16, 18. Each vane includes a cavity 26 opening out outside of the flowpath 20 through the external platform 16. Likewise, each vane includes a cavity (not represented) opening out outside the flowpath through the internal platform 18. These cavities communicate with the flowpath 20 by rows of holes 30 extending axially and/or radially between the internal platform 18 and the external platform 16 along the vanes 13 to open out into the flowpath 20. A gas circulating from outside the flowpath 20 can thus enter the cavity 26, flow in the vane 13, then be discharged into the flowpath 20 through the orifices 30, thus allowing the cooling of the vane 13.

In the remainder of the disclosure, the description is made with reference to the external platform 16, in particular in the figures. However, a similar description is applicable to the internal platform 18.

A sleeve 36 is inserted into the cavity 26 so as to define an orifice 37 on the outer face of the platform 16. It is meant by "outer" the face of the platform opposite the flowpath 20. The sleeve 36 further includes a collar 38 bearing on the outer face of the platform 16. A sleeve (not represented) is also inserted into the cavity on the side of the internal platform 18 so as to define an orifice on the outer face of the internal platform 18.

The nozzle sector 10 also includes sealing strips 12 fixed on the platforms 16, 18, and making it possible to ensure the sealing between the nozzle and an element of the turbomachine 1 which is axially adjacent to the nozzle. More specifically, the sealing strips 12 are fixed on shoulders 161, 162 of the platform 16, through slugs and/or rivets 14.

Figure 2:
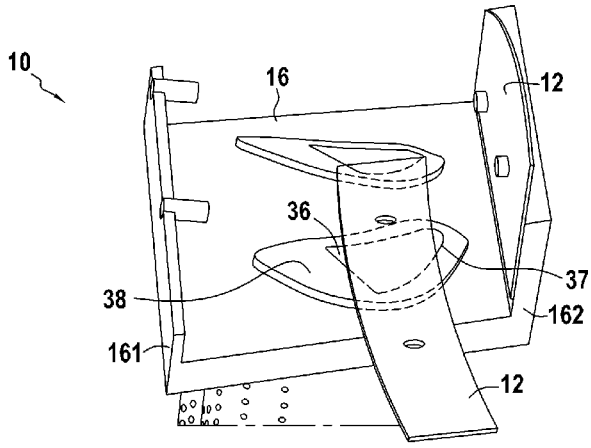
FIG. 2 represents a partial perspective view of a turbine nozzle for a turbomachine according to the prior art, when an orifice is blocked.

FIG. 2 illustrates a configuration that the invention seeks to prevent and according to which, after detachment of a strip 12 from its location of fixing to the high-pressure nozzle due to the shear stresses between the rivets 14 and the strip 12, the latter is sucked by the air entering the cavity 26, and obstructs the orifice 37, thus preventing the air, partially or totally, from entering the cavity 26.

Figure 3:
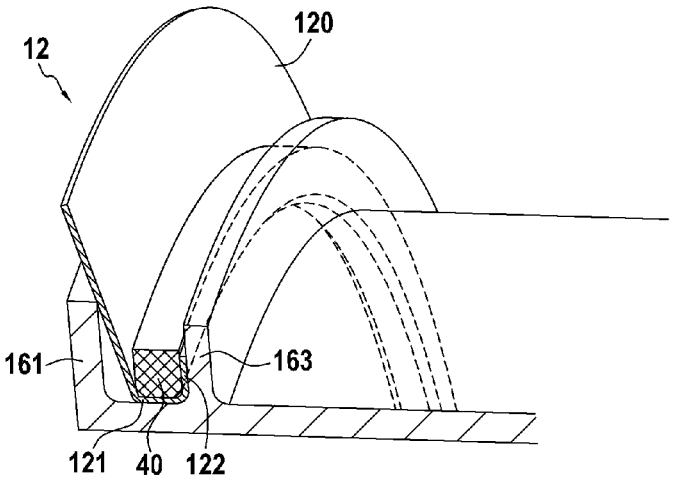
FIG. 3 represents a partial perspective view of a turbine nozzle for a turbomachine according to the present disclosure.

FIG. 3 represents a sector 10 of a high-pressure turbine nozzle for a turbomachine according to one embodiment of the invention. The elements identical to the elements of FIGS. 1 and 2 have the same reference signs and will not be described again. A portion of a strip 12 is illustrated in FIG. 3. However, a nozzle according to the present embodiment, including a plurality of sectors 10 assembled to each other, may include two semi-annular strips 12 extending over 180°, such that they surround the crown of the nozzle when they are assembled to each other. Unlike the sector described with reference to FIGS. 1 and 2, the sector 10 described below does not include rivets 14 for fixing the strips 12 to the shoulders of the platform.

According to this embodiment, each strip 12 includes a main portion 120, a first folded portion 121 and a second folded portion 122. To do so, before the fixing of the strip to the nozzle, the strip 12 is folded at first in two so as to obtain the main portion 120 and the first folded portion 121, and such that the main portion 120 and the first folded portion 121 have therebetween an angle substantially greater than 90°. More specifically, the main portion 120 and the first folded portion 121 have therebetween an angle of $90°+\alpha$, where $\alpha$ is less than 60°, preferably less than 20°. The strip 12 is folded again so as to obtain the second folded portion 122, the first folded portion 121 and the second folded portion 122 being substantially perpendicular to each other. The strip 12 thus formed is thus substantially U-shaped, in section in a transverse cutting plane which extends axially and radially, so as to form a groove or a gutter around the crown of the nozzle when the strips are fixed on the platforms of the nozzle, thus making it possible, when a clamping element is housed in this groove, to thus limit the axial movements thereof. The axial movements of the clamping element and the strips are also limited by a radial wall 163 which radially protrudes from the platform.

In the same way as the strip 12 according to the prior art, the main portion 120 ensures the sealing between the nozzle and the element of the turbomachine 1 which is axially adjacent to the nozzle, for example a flange of the combustion chamber or part of an axially adjacent casing, by being in contact with a shoulder 161 of the platform 16 and the element of the turbomachine 1 which is adjacent to the nozzle. Indeed, when the strip 12 is fixed to the nozzle, and through the inclination of its main portion 120, the element of the turbomachine 1 which is axially adjacent to the nozzle comes into contact with the radial end of the main portion 120 during assembly or during operation of the turbomachine. This contact generates a force on the radial end of the main portion 120, tending to reduce the angle between the main portion 120 and the folded portion 121. The main portion 120, tending to return to its initial position by elasticity, thus acts as a spring by exerting a pressure on the element of the turbomachine 1 which is axially adjacent to the nozzle. The value of the angle $\alpha$ is determined such that, when the nozzle is assembled to the turbomachine, and during normal operation of the latter, a contact still exists between the main portion 120 of the strip 12 and the element of the turbomachine 1 which is axially adjacent to the nozzle.

Figure 6:
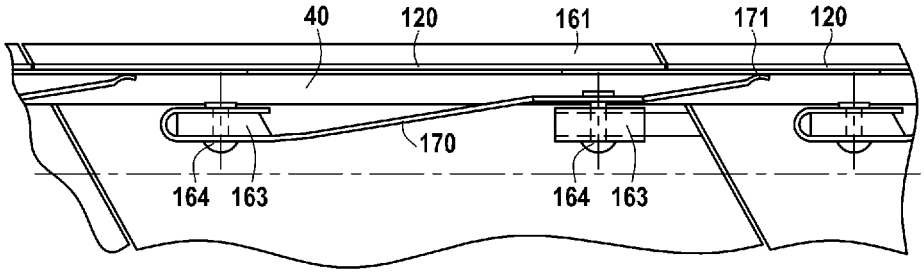
FIG. 6 represents a partial top view of one end of a platform according to the present disclosure.

FIG. 6 represents a partial top view i.e. along the radial direction, of an upstream end of a platform 16. Slats or pins 170 used to exert a pressure on seal covers in order to hold them at the junctions between two circumferentially adjacent strips 12 may be used in order to exert a pressure against the main portions 120 of the strips 12 through a contact portion 171, and thus increase the contact pressure between the main portions 120 and the element of the turbomachine 1, thus further improving the sealing. These pins are fixed on a radial wall 163 by means of a rivet 164. It will be noted that the rivets 164 used to fix these pins 170 to the nozzle are not in contact with the strips 12, which allows limiting the shear damage to the strips 12.

In addition, the first folded portion 121 is pressed against the outer face of the platform 16 by a clamping means 40, the latter being configured to exert pressure in the radial direction on the first folded portion 121, the latter thus being sandwiched between the clamping means 40 and the platform 16. According to this embodiment, the clamping means 40 is a bead that allows simultaneously clamping the two strips 12 by 180° against the outer face of the platforms of the nozzle, the bead being housed in the groove formed by the main portion 120, the first folded portion 121 and the second folded portion 122.

The bead is an open ring, preferably metal ring, for example made of a nickel and/or cobalt-based alloy, having two free ends circumferentially facing each other, but separated from each other. The bead has an initial diameter $D_0$. When these two free ends are moved away from each other, using pliers for example, the metal bead elastically deforms such that its diameter increases, which allows it to be disposed around the nozzle, while keeping the ends away from each other. When the bead is in the desired position, in the groove formed by the strips 12, its free ends are released. The bead then tends to regain its initial shape, until it abuts against the first folded portion 121, thus reaching its final diameter $D_f$, when it clamps the strips 12 against the outer face of the external platforms 16. In order for the force exerted by the clamping means 40 on the first folded portion 121 to be sufficient, i.e. for the clamping means to ensure a clamping that allows preventing the strip from detaching, the initial diameter $D_0$ of the bead must therefore be smaller than the final diameter $D_f$.

This example shows the clamping of a strip 12 on the outer face of an external platform 16. However, the clamping means 40 can also be used to clamp a strip 12 on the outer face of an internal platform 18. In this case, unlike the case described in the previous paragraph, the bead is deformed by bringing together its free ends, causing them to overlap, such that the diameter of the bead decreases. When the bead is in the desired position, in the groove formed by the strips 12, the deformed position of the bead is then released. The diameter of the bead then tends to increase again to regain its initial shape, until it comes into abutment against the first folded portion 121, thus reaching its final diameter $D_f$, when it clamps the strips 12 against the outer face of the internal platforms 18. In order for the force exerted by the clamping means 40 on the first folded portion 121 to be sufficient, i.e. for the clamping means to ensure a clamping that allows preventing the strip from detaching, the initial diameter $D_0$ of the bead must therefore be greater than the final diameter $D_f$.

Although in the embodiment described above, the clamping means 40 is a bead, other clamping means can be envisaged, such as circlips, clamping collars or clips including for example a first portion and a second portion, the first and second portions being fixed together around the nozzle so as to clamp the strips against the outer faces of the platforms of the nozzle.

Figure 4:
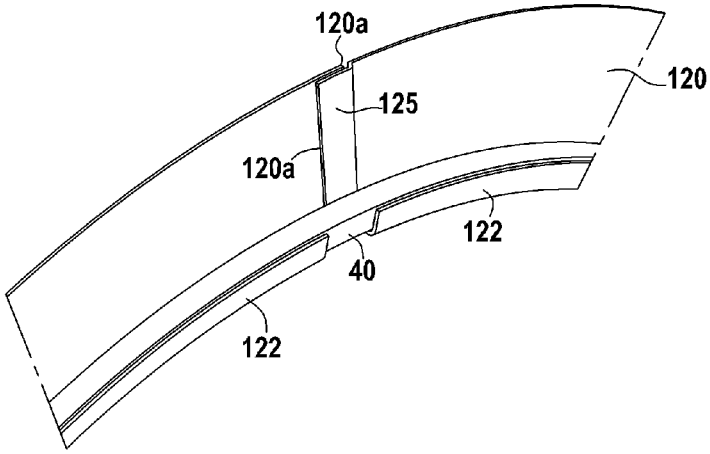
FIG. 4 represents a perspective view of the junction between two strips according to the present disclosure.
Figure 5:
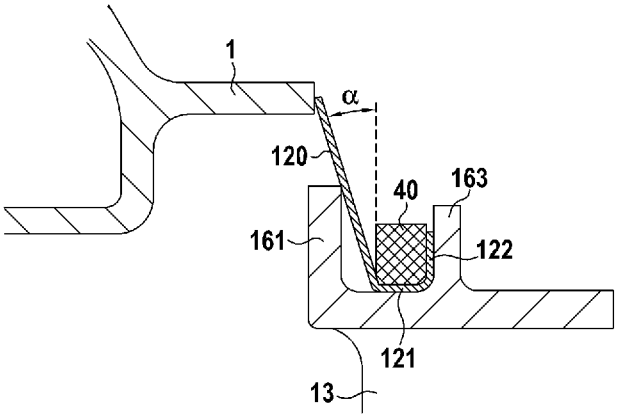
FIG. 5 represents a section of the end of a platform of a nozzle according to the present disclosure.

Furthermore, the main portions 120 of each strip 12 have a circumferential end **120*a*, said circumferential end 120*a* extending along the radial direction. The dimensions of the strips 12 are configured such that the circumferential ends 120*a* of two circumferentially adjacent strips overlap, so as to form an overlap portion 125. This overlap portion 125 allows ensuring the sealing of the junction between two circumferentially adjacent strips 12. The dimensions of the strips 12 are configured such that the overlap portion 125 extends over an angle comprised between 1 and 10°. The overlap portion can also be formed by stamping a circumferential end of a strip 12, thus creating a cut-out portion on one face of the main portion 120, to the circumferential end of this strip 12, the circumferential end of the adjacent strip then being housed in this cut-out portion (cf. FIG. 4**).

In addition, for each strip 12, the length along the circumference (in other words the length of the arc of a circle) of the first folded portion 121 and of the second folded portion 122, is substantially smaller than the length along the circumference of the main portion 120. Thus, only the circumferential ends of the main portions 120 overlap. The circumferential ends of the first folded portion 121 and of the second folded portion 122 of two circumferentially adjacent strips 12 are disjoint from each other. This configuration allows facilitating the assembly of the strips 12 around the nozzle, and in particular the junction of two adjacent strips 12.

Although the present invention has been described with reference to specific exemplary embodiments, it is obvious that amendments and changes can be made to these examples without departing from the general scope of the invention as defined by the claims. Particularly, individual characteristics of the different illustrated/mentioned embodiments can be combined in additional embodiments. Consequently, the description and the drawings should be considered in an illustrative rather than a restrictive sense.

It is also obvious that all the characteristics described with reference to one method are transposable, alone or in combination, to one device, and conversely, all the characteristics described with reference to one device are transposable, alone or in combination, to one method.

The invention claimed is:

1. A nozzle for a turbomachine turbine extending about an axis, the nozzle including a plurality of sectors each comprising at least one vane which extends radially between an internal platform and an external platform, the nozzle including at least two sealing strips each including a main portion configured to ensure the sealing between the nozzle and an element of the turbomachine turbine which is adjacent to the nozzle, and a first portion folded relative to the main portion, the first folded portion being in contact with an outer face of one of the internal platform or external platform, each sealing strip being held to the internal platform or the external platform by a clamping means configured to clamp the first folded portion between the outer face of the platform and the clamping means.

2. The nozzle according to claim 1, wherein the at least two sealing strips each forms a half-ring, the clamping means being disposed around the nozzle so as to clamp the two strips against the outer faces of the platforms of the nozzle.

3. The nozzle according to claim 1, wherein the main portion and the first folded portion of each sealing strip form therebetween an angle comprised between 90° and 150°.

4. The nozzle according to claim 1, wherein the sealing strips each include a second folded portion extending from the first folded portion, substantially perpendicularly thereto, and coming into contact with a radial wall which protrudes radially from one of the internal platform or external platform.

5. The nozzle according to claim 4, including at least one slat fixed to the radial wall, and configured to exert pressure on one of the sealing strips.

6. The nozzle according to claim 1, wherein the at least two sealing strips are circumferentially adjacent around the nozzle disposed such that a circumferential end of the main portion of one of the at least two sealing strips is superimposed on a circumferential end of the main portion of an adjacent sealing strip of the at least two sealing strips.

7. The nozzle according to claim 6, wherein the circumferential end of the main portion of one of the at least two sealing strips and the circumferential end of the main portion of the adjacent sealing strip are superimposed over a distance comprised between 1 and 10 mm.

8. The nozzle according to claim 1, wherein the clamping means includes at least one clamping surface, the clamping surface being in contact with the first folded portion of each of the at least two sealing strips.

9. The nozzle according to claim 1, wherein the clamping means is a bead.

10. A turbomachine including the nozzle according to claim 1.

* * * * *